US005584478A

United States Patent [19]

Michels et al.

[11] Patent Number: 5,584,478

[45] Date of Patent: Dec. 17, 1996

[54] DEVICE FOR PRECISELY POSITIONED ALIGNMENT OF SINGLY FED SHEETS

[75] Inventors: Heinz Michels, Wolfschlugen; Helmut Funk, Remshalden, both of Germany

[73] Assignee: Eastman Kodak Company, Rochester, N.Y.

[21] Appl. No.: 499,831

[22] Filed: Jul. 10, 1995

[30] Foreign Application Priority Data

Jul. 13, 1994 [DE] Germany ..... 44 24 642.0

[51] Int. Cl.[6] ..... B65H 9/16

[52] U.S. Cl. ..... 271/251; 271/236

[58] Field of Search ..... 271/236, 245, 271/251, 250

[56] References Cited

U.S. PATENT DOCUMENTS

| | | | |
|---|---|---|---|
| 5,388,022 | 8/1994 | Funk et al. | 271/184 |
| 5,460,457 | 10/1995 | Mindler et al. | 271/251 |

FOREIGN PATENT DOCUMENTS

| | | | |
|---|---|---|---|
| 0585915A2 | 9/1993 | European Pat. Off. | B65H 31/34 |
| 900441 | 12/1943 | France | B65H 31/36 |
| 3107768C2 | 2/1981 | Germany | B65H 31/36 |
| 3808661A1 | 3/1988 | Germany | B65H 31/36 |
| 4212764C1 | 4/1992 | Germany | B65H 33/10 |
| 4229426A1 | 9/1992 | Germany | B65H 9/16 |
| 5-330702 | 12/1993 | Japan | 271/251 |

OTHER PUBLICATIONS

IBM Technical Disclosure Bulletin, Skewed Drive, Arsenault et al, Oct. 1980, vol. 23 No. 5 pp. 1817–1819.

*Primary Examiner*—H. Grant Skaggs
*Attorney, Agent, or Firm*—Lawrence P. Kessler

[57] ABSTRACT

A bearing part (7 or 20) is arranged on a continuously driven drive shaft (4) arranged parallel to the transport plane of a sheet (6) to be aligned and at right angles to the sheet transport direction (A), on which bearing part an aligning roller (5 or 15 or 16 or 18 or 21) at an oblique angle (α) to said sheet transport direction (A) is rotatably mounted. The bearing part (7 or 20) is stationarily secured against turning and moving, and is freely passed through by the drive shaft (4). The aligning roller (5 or 15 or 16 or 18 or 21) is mounted rotationally symmetrical to said drive shaft (4).

The drive shaft (4) and the rotatably and obliquely mounted aligning roller (5 or 15 or 16 or 18 or 21) are connected to one another by a positive coupling (5*a*, 8 or 14, 15*a*, or 17 or 19).

Several bearing parts (7 or 20) with aligning rollers (5 or 15 or 16 or 18 or 21) can be arranged on the drive shaft (4) and be driven by one and the same drive shaft (4).

17 Claims, 7 Drawing Sheets

DEVICE FOR PRECISELY POSITIONED ALIGNMENT OF SINGLY FED SHEETS

Figure 1:
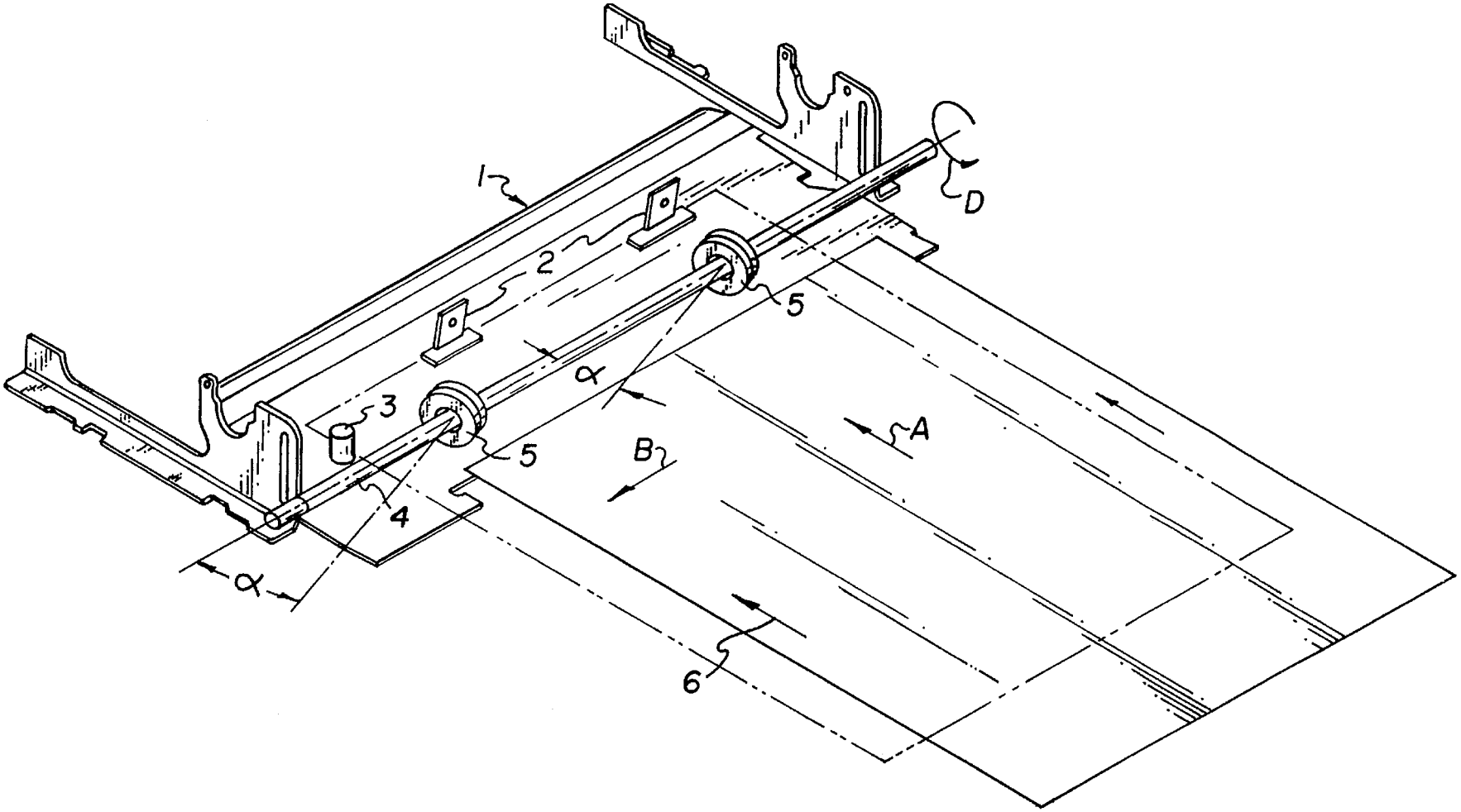

The invention relates to a device for precisely positioned alignment of singly fed sheets that are aligned on a front stop projecting into the sheet transport path and on a lateral stop arranged parallel to the sheet transport direction, having at least one aligning element resting on the surface of the sheet to be aligned, rotatably mounted and driven in the sheet transport direction, said aligning element being arranged at an angle to the lateral stop, obliquely to the sheet transport direction.

In a device of this type known from DE-C-31 07 768, an obliquely arranged roller is provided that serves to align sheets on a front stop and on a lateral stop. The known roller is rotatably mounted on a support arm that is swivellable about a drive shaft and is drivable via the latter using pulling means, with all drive and bearing means being arranged in the same oblique position as the roller.

In a known device for stacking sheets (DE-A-38 08 661), a fan wheel is used that is obliquely arranged and rotatably mounted on an angled arm of a support element such that the fan wheel moves, by means of its oblique position, the arriving sheets both forwards and to the side and at the same time aligns them with the walls of an exit compartment. The roller is driven via a drive shaft arranged transversely to the sheet transport direction and on which the support element is mounted. The drive shaft drives the fan wheel by a pulling means passing over deflection pulleys to the obliquely positioned fan wheel.

Both the said devices involve a large number of transmissions and require a relatively large amount of space.

The object of the invention is to develop a sheet aligning device of the genetic type such that it is suitable for a space-saving arrangement and also permits several aligning elements to be driven by a single drive shaft.

This is achieved in accordance with the invention in that:

- the obliquely positioned aligning element is mounted rotatably on a bearing part that is arranged on a rotatable drive shaft arranged parallel to the sheet transport plane and at right angles to the sheet transport direction,
- the aligning element is mounted rotationally asymmetrical to the drive shaft,
- the bearing part is stationarily secured against turning and moving, and the drive shaft passes through the bearing part in freely rotatable manner, and
- the drive shaft and the rotatable aligning element are connected to one another by a positive or non-positive coupling.

In an advantageous design of the invention, the coupling between the drive shaft and the obliquely arranged aligning element is effected by a hexagon driver fastened on the drive shaft and having faces of circle arc form in the direction of the rotational axis of the drive shaft, said driver being positively engaged with an internal hexagon arranged on the aligning element.

In a further advantageous design of the invention, the coupling between the drive shaft and the obliquely arranged aligning element is effected by a driver wheel fastened on the drive shaft and having several projections arranged symmetrically to the rotation axis of the drive shaft and positively engaging in an identical number of recesses of the aligning element.

A further advantageous design of the invention provides for a conically wound helical compression spring as the coupling between the drive shaft and the obliquely arranged aligning element, the smaller diameter of said spring being fastened to the shaft and the larger diameter to the aligning element.

The coupling between the drive shaft and the obliquely arranged aligning element can, in an advantageous design, also be made by a tube-like, torsion-stable bellows of which one end is fastened to the drive shaft and the other end to the aligning element.

With the design and arrangement in accordance with the invention of the aligning device, it is achieved in advantageous form that several obliquely positioned aligning elements are arranged on one and the same drive shaft and can be driven by the latter.

Figure 2:
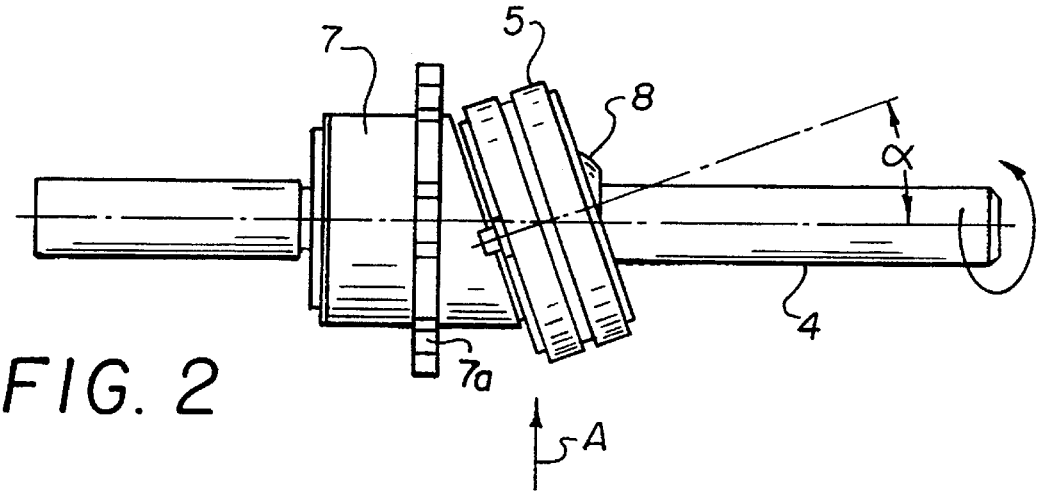
Figure 3:
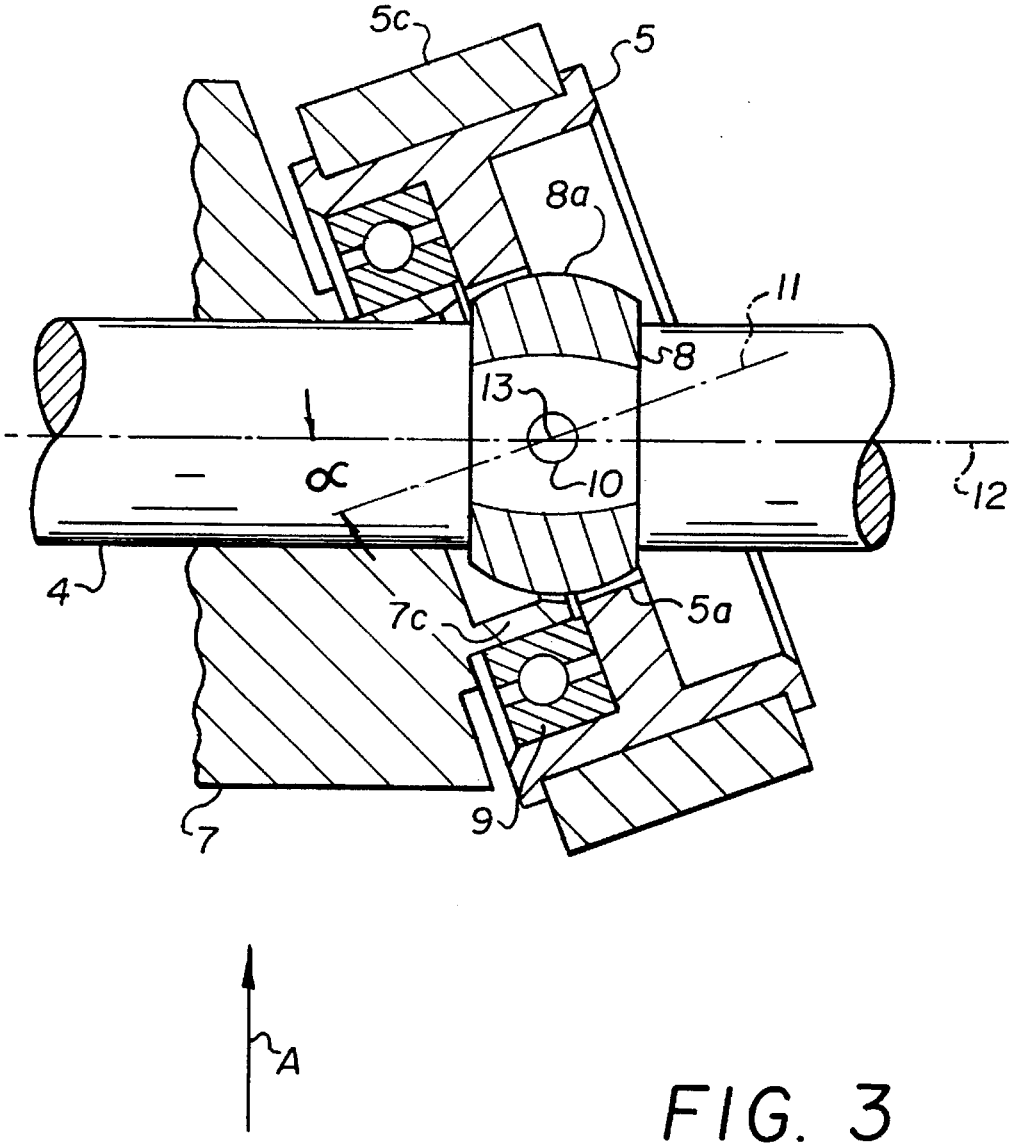
Figure 4:
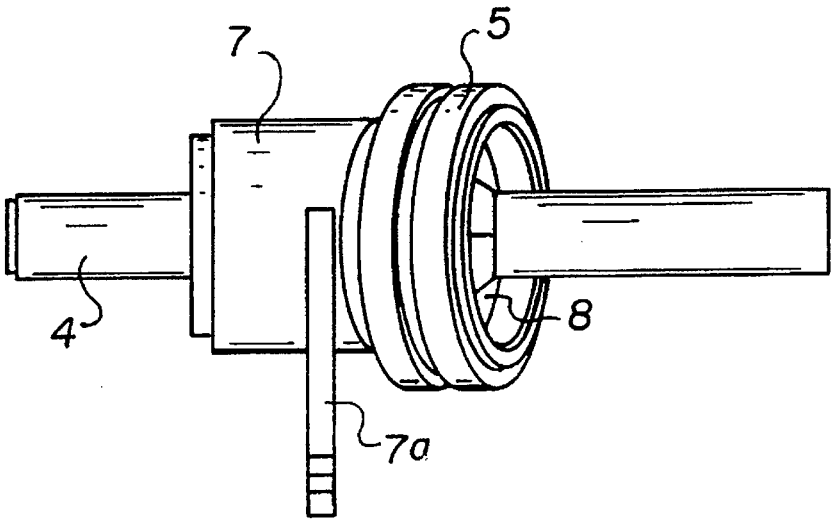
Figure 5:
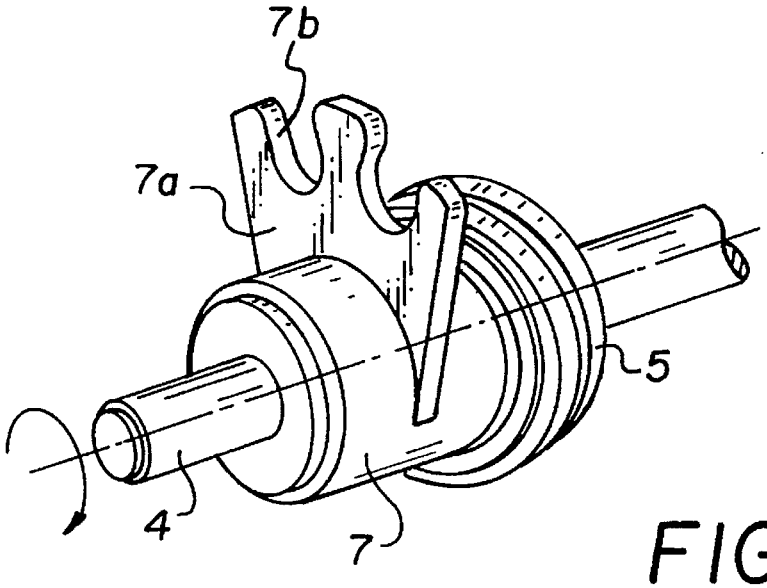
Figure 6:
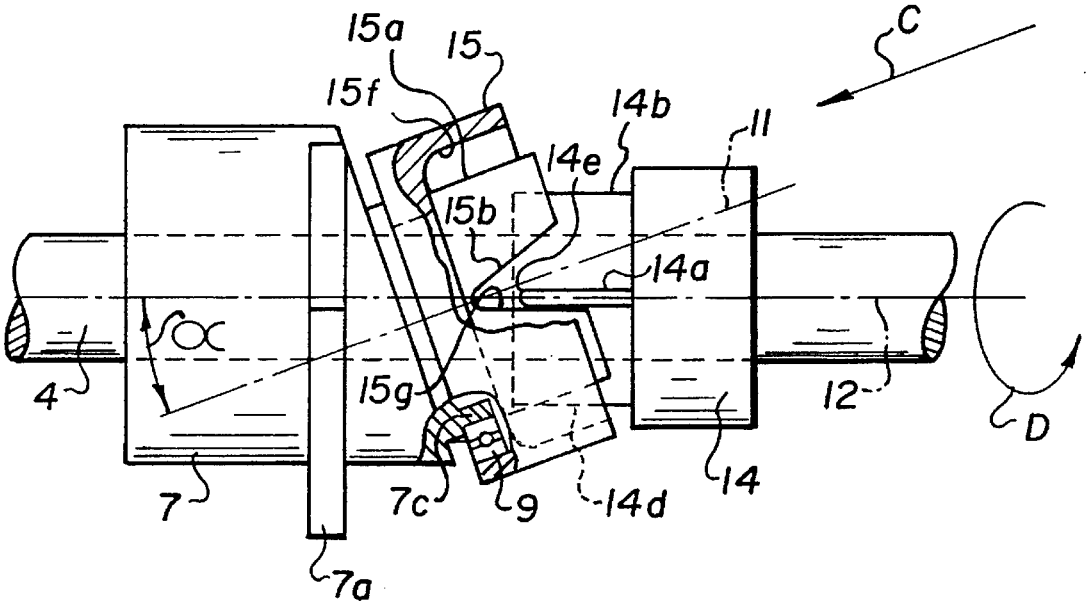
Figure 7:
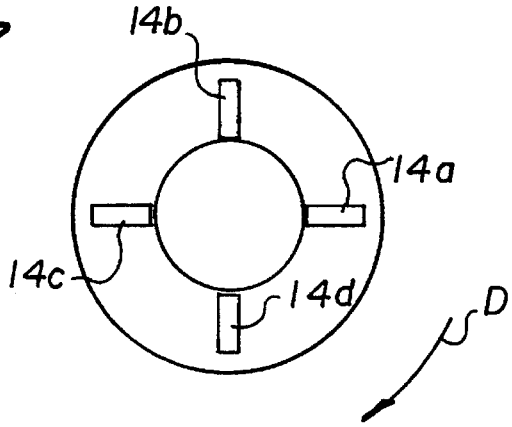
Figure 8:
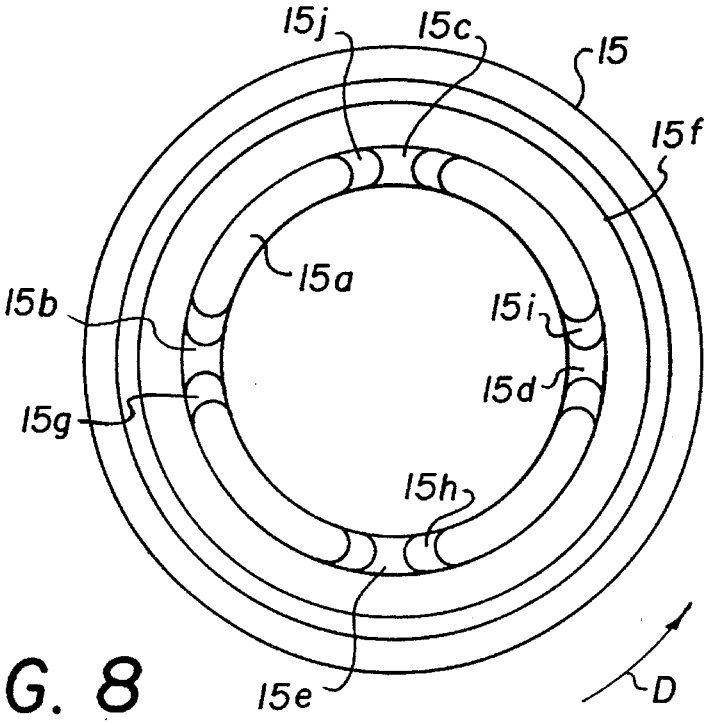
Figure 9:
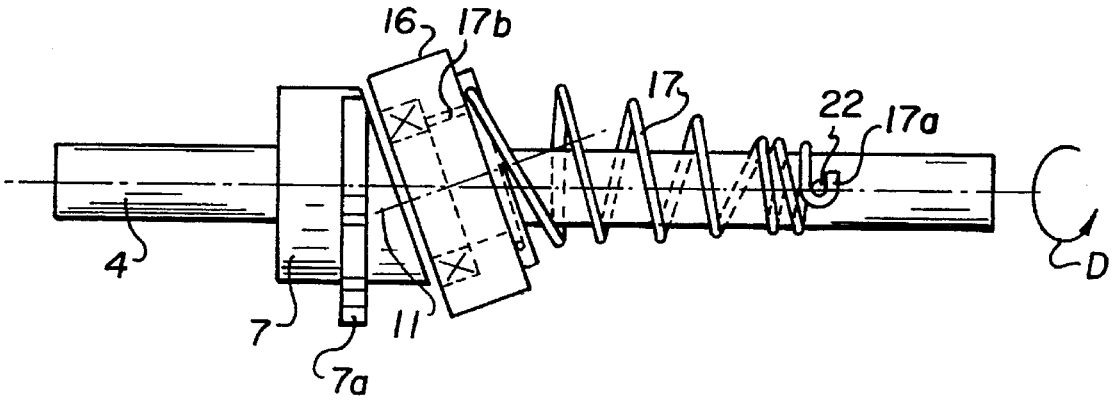
Figure 10:
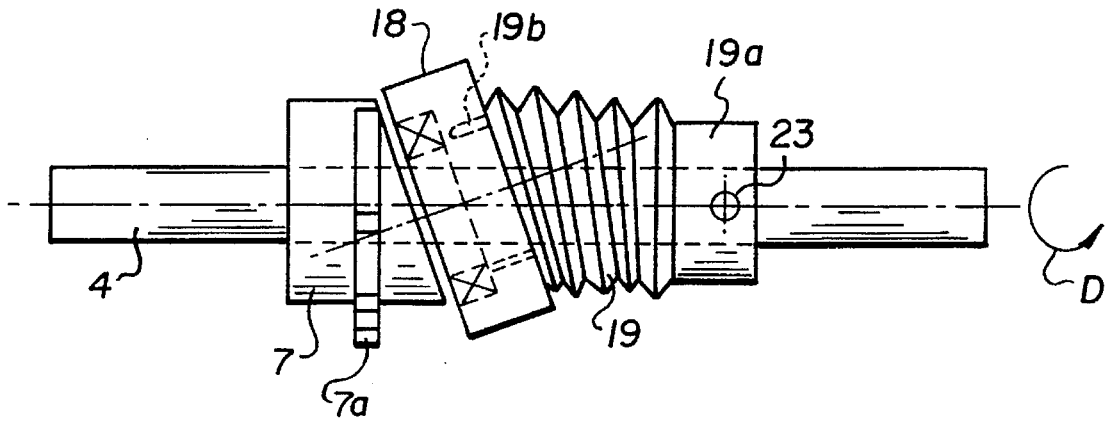
Figure 11:
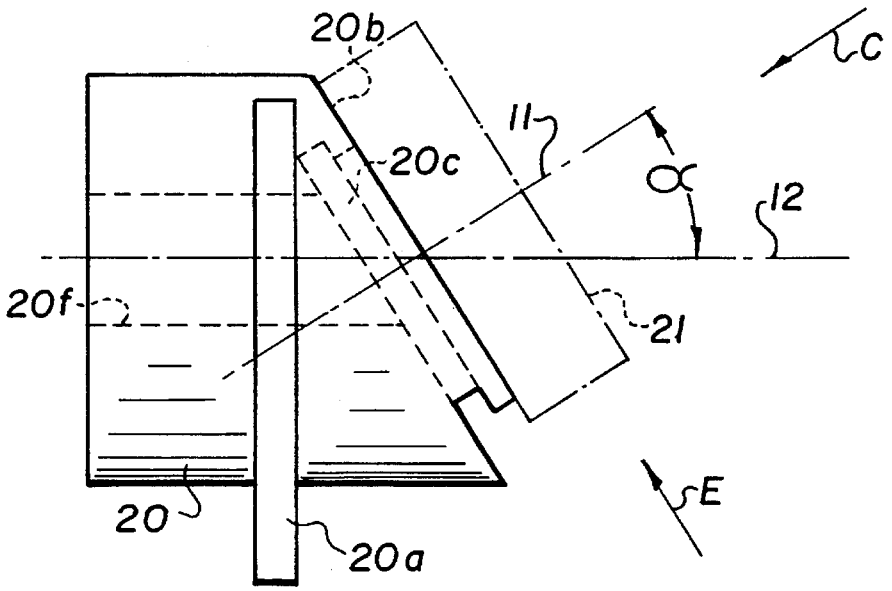
Figure 12:
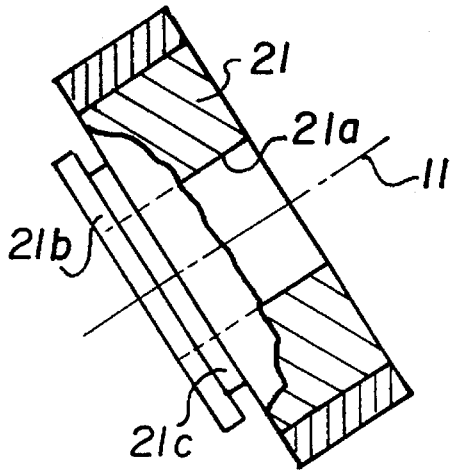
Figure 13:
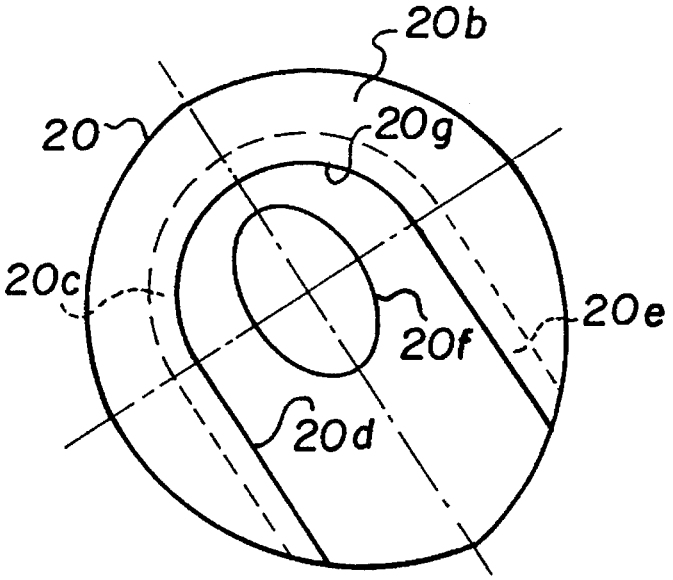

Further features and advantages are set forth in the description of embodiments of the invention shown by the drawing and in the subclaims. The drawings show, in diagrammatic form, in:

FIG. 1 the device simplified to the principle of the arrangement in an oblique view;

FIG. 2 the device according to FIG. 1 in a plan view onto one of the aligning elements;

FIG. 3 the aligning element according to FIG. 2 in section;

FIG. 4 the device according to FIG. 1 in a view facing the sheet transport direction;

FIG. 5 the device according to FIG. 1 in an oblique view;

FIG. 6 a further embodiment of an aligning element and its driver wheel, partially in section;

FIG. 7 a view of the driver wheel in accordance with FIG. 6, seen in the axis direction;

FIG. 8 a view of the aligning element in accordance with FIG. 6, seen in the direction of the arrow "C", without its bearing and drive parts;

FIG. 9 a further embodiment of the device in accordance with FIG. 2, but with a helical compression spring as the drive coupling;

FIG. 10 a further embodiment of the device in accordance with FIG. 2, but with a bellows as the drive coupling;

FIG. 11 an embodiment of a bearing part for the aligning element in accordance with FIG. 2;

FIG. 12 an aligning element for mounting in the bearing part in accordance with FIG. 11, in a simplified representation partially in section; and FIG. 13 the bearing part in accordance with FIG. 11, seen in the direction of arrow "C".

The aligning device in accordance with the invention is described in conjunction with a copier, not shown, of commercially available type, in which a single sheet from a paper supply is first stopped and precisely aligned in an aligning station 1 before being conveyed further to a image transmission station.

On the basis of FIG. 1, the arrangement principle is first described of the sheet aligning station 1 that is arranged a short distance from the image transmission station of known type, not shown.

The aligning station 1 has a sliding surface of known type, not shown, in the transport plane, on which surface single sheets 6 are transported in the direction of the arrow "A" by transport means of known type, not shown.

At that end of the aligning station 1 facing the image transmission station, stops 2 are arranged that serve to align a sheet 6 at the front. The stops 2 are fastened to a rotatably mounted shaft, not shown, such that they are swivellable out of the transport path of the sheet 6 by turning in the direction of the arrow "A". A laterally arranged, stationary stop 3 designed as a rotatably mounted roller is used for lateral alignment of the sheet 6.

At the front part of the aligning station 1 adjacent to the stops 2 and 3, a drive shaft 4 is rotatably mounted and continuously driven in the direction of the arrow "D" by drive means of known type, not shown. The drive shaft is arranged above the sheet transport plane and parallel thereto, and vertical to the sheet transport direction "A". Two bearing parts 7 are arranged on the drive shaft 4, on which parts aligning rollers 5 are rotatably mounted through which the drive shaft 4 passes in freely rotatable manner, such that the latter does not in itself exert any drive effect on these rollers.

The bearing parts 7 and the aligning rollers 5, as well as other components yet to be described, are identically designed, so that only one of these assemblies is described in the following.

As shown in FIG. 5 in particular, the bearing part 7 has an arm 7*a* with a recess 7*b* that positively engages in a holder, not shown, arranged stationarily on the equipment, thereby preventing the bearing part 7 from either rotating or moving.

The bearing part 7 has a flange 7*c*, shown by FIG. 3 in particular, that serves for rotatable mounting of the aligning roller 5. The flange 7*c* is arranged at an angle a of 20ø such that the aligning roller 5 mounted thereon is mounted obliquely to the lateral stop 3 in accordance with FIG. 1. A ball bearing 9 is fastened to the flange 7*c*, on which bearing the aligning roller 5 is rotatably mounted rotationally symmetrical to the rotation axis 12 of the drive shaft 4. A friction lining 5*c* of standard type is arranged on the outer circumference of the aligning roller 5.

The aligning roller 5 is provided with an internal hexagon 5*a* (see FIG. 3) that is designed and arranged symmetrical to an imaginary intersection point 13 formed by the rotation axes 11 and 12 of the aligning roller 5 and the drive shaft 4.

A hexagon driver 8 designed and arranged symmetrical to the aforementioned intersection point 13 is fastened on the drive shaft 4 by means of a pin 10. The surfaces 8*a* of the hexagon driver are of circular arc form in the direction of the rotation axis 12 of the drive shaft 4, said radius of the circular arc-form surfaces 8*a* extending from the aforementioned intersection point 13. The hexagon driver 8 positively engages with the internal hexagon 5*a* of the drive shaft 5. The area of the sliding surface of the aligning station 1 with which the aligning roller 5 or its friction lining 5*c* is in contact is spring-pretensioned (not shown) against the aligning roller 5, 5*c*, such that the friction conditions between the aligning roller 5, 5*c* and the sheet 6 to be aligned remain substantially identical even as abrasion from the friction lining 5*c* increases.

By the oblique position of the aligning rollers 5 at the angle a, a sheet 6 entering the aligning station in the direction of the arrow "A" is, when it comes within effective range of the aligning rollers 5, further transported in the direction of the arrow "A". At the same time, the sheet 6 is additionally moved in the direction of the arrow "B" transversely to the sheet transport direction "A" towards the lateral stop 3, such that the sheet 6 contacts both the stops 2 at the front and the stop 3 at the side, thereby precisely aligning it. When the aligned sheet has stopped, the aligning rollers 5 slip onto the sheet 6. After a brief halt of the sheet movement after alignment, the sheet 6 is freed by the stops 2 swiveling clear for further transport in the direction of the arrow "A". Immediately after this release, the sheet is taken up by following transport rollers, not shown, that transport it in precisely aligned form to the following image transmission station (not shown).

In a second embodiment shown in FIGS. 6 to 8 and described in the following, the coupling between the drive shaft 4 and an aligning roller 15 is achieved by a driver wheel 14. The driver wheel 14 positively engages in the aligning roller 15, that in its mounting and arrangement is identical to the aligning roller 5 in accordance with FIGS. 1 to 5.

The driver wheel 14 shown in FIGS. 6 and 7 is attached to the drive shaft 4 and has four web-like projections 14*a*, 14*b*, 14*c* and 14*d* arranged symmetrically to the rotation axis 12 of the drive shaft 4 and at 90ø to one another. The projections 14*a* to 14*d* facing the aligning roller 15 are arranged vertical as well as parallel to the rotation axis 12 of the drive shaft 4 and have rounded surfaces at their top ends 14*e*. The aligning roller 15 shown in FIGS. 6 and 7 in particular has on its side facing the driver wheel 14 a projection 15*a* of hollow-cylinder type arranged rotationally symmetrical to the rotation axis 11 of the aligning roller 15. Four V-shaped recesses 15*b*, 15*c*, 15*d* and 15*e* at 90ø to one another and open to the projections 14*a* to 14*d* of the driver wheel 14 are provided on this projection and serve to ensure a positive engagement of the driver wheel 14.

The V-shaped recesses 15*b* to 15*e* have an aperture angle extending towards the driver wheel 14 that is twice the size of the oblique angle a. The recesses 15*b* to 15*e* are arranged symmetrical to the rotation axis 11 of the aligning element 15. The end faces 15*g* to 15*j* of the recesses 15*b* to 15*e* are furthermore provided transversely to the rotation axis 11 of the aligning element 15 with convex ends, see in particular FIG. 8.

By the V-shaped design of the recesses 15*b* to 15*e*, the projections 14*a* to 14*d* of the driver wheel 14 smoothly engage or disengage in a manner yet to be described their respective recesses 15*b* to 15*e* of the aligning roller 15.

The arrangement and allocation of the driver wheel and the aligning roller 15 was designed, as shown in FIG. 6, such that the closed ends of the recesses 15*b* to 15*e* are arranged in an area of the hollow-cylinder projection 15*a* of the aligning element 15 that is in an imaginary intersection point of the rotation axis 12 of the drive shaft 4 with the rotation axis 11 of the aligning element 15.

In the area of the aligning roller 15 adjacent to the outer diameter of the projection 15*a*, which area is substantially within the width of the aligning roller 15, the aligning roller 15 is provided with a free recess 15*f* that exposes the movement path for the engagement of the projections 14*a* to 14*d* on the aligning roller 15. See FIG. 6 in this respect.

The mode of operation of the device in accordance with FIGS. 6 to 8 is as follows:

When the drive shaft 4 is turned in the direction of the arrow "D", one of the projections 14*a* engages in a recess 15*b* and also turns, while contacting the end face 15*g* of the projection 15*a*, the aligning roller 15 in the rotation direction "D". Here the projection 14*a* slides along the end face 15*g* and at the same time first dips ever deeper into the recess 15*b* as far as a lowest engagement position indicated in FIG. 6 for the projection 14*d*. Then the respective projection leaves more and more its associated recess, and a recess 14*b* following in the rotation direction engages in the following recess in the manner described above. In this way, the projections 14*a* to 14*d* engage one after the other and rotate the aligning roller 15 in the direction of the arrow "D". The fact that the end faces 15*g* to 15*j* of the recesses 15*b* to 15*e* and the ends 14*e* of the projections 14*a* to 14*d* are rounded as already mentioned ensures a low-friction engagement between the driver wheel 14 and the aligning roller 15.

A third embodiment shown in FIG. 9 provides for a conically wound helical compression spring 17 as the coupling between the drive shaft 4 and an aligning roller 16, which is designed and arranged as described in the previous embodiments. The helical compression spring 17 is fastened by means of a pin 22 to the drive shaft 4 by its one end 17*a* arranged at the smaller diameter. At the larger diameter of the other end, the helical compression spring 17 positively engages in the aligning roller 16 via an angled end 17*b*. When the drive shaft 4 is rotated, the aligning roller 16 is also rotated in the same direction by the helical compression spring 17, with the loosely wound spring coils compensating by their spring-elasticity for the changing transmission ratios.

A fourth embodiment in accordance with FIG. 10 differs from the preceding one only in that a tube-like, torsion-stable bellows 19 is used for coupling between the drive shaft 4 and an aligning roller 18. The bellows 19 is fastened by its one end 19*a* to the shaft 4 by means of a pin 23 and engages positively in the aligning roller 18 with projections 19*b* arranged at its other end.

Unlike the mounting of the obliquely positioned aligning roller as described in the preceding embodiments, this mounting can also be in the manner shown in FIGS. 11 to 13.

The bearing part 20 in accordance with FIGS. 11 and 13 is in part identical to that described in FIGS. 1 to 5, i.e. it has an all-through hole 20*f* through which the drive shaft 4 passes in freely rotatable manner, and it is provided with an arm 20*a* that is used to secure the position and prevent rotation of the bearing part 20.

Arranged on the bearing part 20 is, as shown in FIG. 11, a flange 20*b* positioned at an oblique angle a of 20ø and determining the necessary oblique position of an aligning roller 21. The flange 20*b* is provided with an annular groove 20*c* arranged concentrically to the rotation axis 11 of the aligning roller 21 and open to one side vertically to the rotation axis 11 by parallel grooves 20*d*, 20*e*. A recess 20*g* , shown in FIG. 13 in particular, and having a clear width less than the diameter of the annular groove 20*c* is provided on the flange 20*b* concentrically to the annular groove 20*c* and parallel to the grooves 20*d*, 20*e*.

A T-shaped flange 21*b* of the aligning roller 21 engages in these guidance and retaining grooves 20*c* to 20*e* and 20*g* and is arranged rotationally symmetrical to the aligning roller 21. An internal hexagon 21*a*, with which a hexagon driver 8 in accordance with FIGS. 2 to 4 is engageable, is provided on the aligning roller 21.

The bearing part 20 and the aligning roller 21 are assembled such that first the aligning roller 21 with the T-shaped flange 21*b*, 21*c* is pushed in the direction of the arrow "E" into the guidance and retaining grooves 20*c* to 20*e* and 20*g*. Then the pre-assembly 20, 21 is placed at its intended point of the equipment and fixed by insertion of the drive shaft 4 and the hexagon driver 8.

Unlike in the previously described embodiments, it is also possible to provide a non-positive coupling (not shown) between drive shaft 4 and aligning roller 16 when—for example—a helical compression spring 17 in accordance with FIG. 9 is in contact with aligning roller 16 only under spring pretension and moves this roller in the direction of the arrow "D" by non-positive connection. It is also possible to arrange a rotatable fan wheel (not shown) with elastic wing arms of known type on the bearing part 7 or 20 instead of an aligning roller, with otherwise identical design and identical mode of operation of the aligning device.

In all the embodiments described above, it is also possible to arrange several aligning rollers 5 or 15 or 18 or 21 on one and the same drive shaft 4 and to have them driven by this shaft, with the same mode of operation.

We claim:

1. Device for precisely positioned alignment of singly fed sheets that are aligned on a front stop projecting into the sheet transport path and on a lateral stop arranged parallel to the sheet transport direction, having at least one aligning element resting on the surface of the sheet to be aligned, rotatably mounted and driven in the sheet transport direction, said aligning element being arranged at an angle to said lateral stop and obliquely to said sheet transport direction, characterized in that said obliquely positioned aligning element (5; 15; 16; 18; 21) is mounted rotatably on a bearing part (7; 20) that is arranged on a rotatable drive shaft (4) arranged parallel to the sheet transport plane and at right angles to said sheet transport direction (A), said aligning element (5; 15; 16; 18; 21) is mounted rotationally asymmetrical to said drive shaft (4), said bearing part (7; 20) is stationarily secured against turning and moving and said drive shaft (4) passes through said bearing part (7; 20) in freely rotatable manner, and said drive shaft (4) and said rotatable aligning element (5; 15; 16; 18;, 21) are connected to one another by a positive or non-positive coupling (5*a*; 14; 17; 19).

2. Device according to claim 1, characterized in that said bearing part (7) has a flange (7*c*; 20*b*) arranged at an angle (a) oblique to said sheet transport direction (A) and in that said aligning element (5; 15; 16; 18; 21) is rotatably mounted on said obliquely positioned flange (7*c*; 20*b*).

3. Device according to claim 2, characterized in that a hexagon driver (8) is fastened on said drive shaft (4), the surfaces (8*a*) of said hexagon driver (8) are of circular arc form in the direction of the rotation axis (12) of said drive shaft (4), and said aligning element (5) is provided with an internal hexagon (5*a*) in which said hexagon driver (8, 8*a*) positively engages.

4. Device according to claim 3, characterized in that the radius of said circular arc-form surfaces (8*a*) of said hexagon driver (8) extends from an intersection point (13) on the rotation axis (12) of said drive shaft (4), said hexagon driver (8, 8*a*) is designed symmetrical to said intersection point (13), and said internal hexagon (5*a*) of said aligning element (5) is arranged symmetrical to said intersection point (13) of said hexagon driver (8) and symmetrical to a rotation axis (11) of said aligning element (5) passing through said intersection point (13).

5. Device according to claim 4, characterized in that said flange (20*b*) of said bearing part (20) is provided with an annular groove or groove (20*c* or 20*d*, 20*e*) with a first, larger diameter, arranged concentrically to said rotation axis (11) of said aligning element (21) and open to one side vertically to said rotation axis (11), and an opening (20*g*) arranged concentrically or symmetrically thereto with a second, smaller diameter or smaller width.

6. Device according to claim 5, characterized in that said aligning element (21) has a T-shaped flange (21*b*, 21*c*) arranged rotationally symmetrical to the rotation axis of said element (21) and positively engaging in said laterally open annular groove or groove (20*c* or 20*d*, 20*e*) of said bearing part (20).

7. Device according to claim 6, characterized in that several bearing parts (7 or 20) and aligning elements (5 or 15 or 16 or 18 or 21) are arranged on said drive shaft (4) and are coupled to said drive shaft (4).

8. Device according to claim 7, characterized in that said aligning element is designed as an aligning roller (5 or 15 or 16 or 18 or 21).

9. Device according to claim 7, characterized in that said aligning element (5 or 15 or 16 or 18 or 21) is designed as a fan wheel with elastic wing arms.

10. Device according to claim 2, characterized in that a driver wheel (14) having several projections (14*a* to 14*d*) is fastened on said drive shaft (4) symmetrical to the rotation axis (12) of said drive shaft (4) and facing said aligning element (15), said projections (14*a* to 14*d*) are web-like and are spaced at identical intervals from one another, and said projections (14*a* to 14*d*) are arranged vertical and parallel to said rotation axis (12) of said drive shaft (4).

11. Device according to claim 10, characterized in that a projection (15*a*) of hollow-cylinder type arranged rotationally symmetrical to the rotation axis (11) of said aligning roller (15) is arranged on that side of said aligning element (15) facing said driver wheel (14), several recesses (15*b* to 15*e*) identical in number to said projections (14*a* to 14*d*) of said driver wheel (14) are provided on said hollow-cylinder projection (15*a*), in which recesses said projections (14*a* to 14*d*) of said driver wheel (14) engage, said recesses (15*b* to 15*e*) are arranged rotationally symmetrical to said rotation axis (11) of said aligning element (15) and at identical intervals from one another, said recesses (15*b* to 15*e*) are V-shaped and have an aperture angle extending towards said driver wheel (14) that is twice the size of the oblique angle (a), and said V-shaped recesses (15*b* to 15*e*) are arranged symmetrical to said rotation axis (11) of said aligning element (15).

12. Device according to claim 11, characterized in that the closed end of the recesses (15*b* to 15*e*) facing away from said driver wheel (14) is arranged in an area of said hollow-cylinder projection (15*a*) of said aligning element (15) that is in an imaginary intersection point of said rotation axis (12) of said drive shaft (4) with said rotation axis (11) of said aligning element (15).

13. Device according to claim 12, characterized in that said hollow-cylindrical projection (15*a*) of said aligning element (15) is arranged substantially within the width of said aligning element (15), and the area of said aligning element adjacent to the outer diameter of said hollow-cylindrical projection (15*a*) is provided with a free recess (15*f*) that exposes the movement path for the engagement of said projections (14*a* to 14*d*) on said aligning element (15).

14. Device according to claim 2, characterized in that said drive shaft (4) and said aligning element (16) are coupled to one another by a helical compression spring (17), which is fastened to said drive shaft (4) by its one end (17*a*) and to said aligning element (16) by its other end (17*b*).

15. Device according to claim 14, characterized in that said helical compression spring (17) is conically wound and fastened to said shaft (4) by its smaller diameter and to said aligning element (16) by its larger diameter.

16. Device according to claim 2, characterized in that said drive shaft (4) and said aligning element (18) are coupled by a tubelike, torsion-stable bellows (19) fastened by its one end (19*a*) to said drive shaft (4) and by its other end (19*b*) to said aligning element (18).

17. Device according to claim 2, characterized in that said aligning element (16 or 18) is driven by a helical compression spring attached to said drive shaft (4) and in non-positive contact with said aligning element (16 or 18).

* * * * *